United States Patent [19]

Nakajima et al.

[11] Patent Number: 4,525,449

[45] Date of Patent: Jun. 25, 1985

[54] METHOD OF TREATMENT OF COLOR PHOTOGRAPHIC MATERIALS

[75] Inventors: Junya Nakajima; Kiyoshi Imai; Takashi Nakamura, all of Kanagawa, Japan

[73] Assignee: Fuji Photo Film Company, Limited, Kanagawa, Japan

[21] Appl. No.: 547,617

[22] Filed: Nov. 1, 1983

[30] Foreign Application Priority Data

Nov. 1, 1982 [JP] Japan ..... 57-192097

[51] Int. Cl.[3] ..... G03C 7/40; G03C 5/50

[52] U.S. Cl. ..... 430/407; 430/379; 430/421; 430/423

[58] Field of Search ..... 430/379, 421, 423, 407

[56] References Cited

U.S. PATENT DOCUMENTS

| | | | |
|---|---|---|---|
| 3,201,242 | 8/1965 | Schwan et al. | 430/379 |
| 4,072,523 | 2/1978 | Pollet et al. | 430/407 |
| 4,072,526 | 2/1978 | Sels et al. | 430/407 |
| 4,292,400 | 9/1981 | Pollet et al. | 430/407 |

*Primary Examiner*—Mary F. Downey

*Attorney, Agent, or Firm*—Sughrue, Mion, Zinn, Macpeak and Seas

[57] ABSTRACT

A method of color reversal treatment of an exposed silver halide photographic material is disclosed. The method involves treating the exposed material with 2 both type black-and-white developing solutions. The first solution contains a compound represented by the general formula (I):

$$R_2\text{-}(\text{S}-R_1)_d-\text{S}-R_2 \qquad \text{(I)}$$

wherein $R_1$ represents an alkylene group having 2 to 10 carbon atoms, which may have ether bonds, $R_2$ represents an alkyl group having 2 to 10 carbon atoms which alkyl group may have substituents, ether bonds or ester bonds, and d represents an integer of 0 to 3. The second black-and-white developing solution is a conventional solution. By utilizing the two solutions and specifically the first solution containing the compound of general formula (I) it is possible to obtain good photographic images having a high maximum density and good color balance. Further, images having different sensitivities can be obtained with the identical photographic materials when the conditions are varied.

16 Claims, No Drawings

METHOD OF TREATMENT OF COLOR PHOTOGRAPHIC MATERIALS

FIELD OF THE INVENTION

The present invention relates to a method of treatment of silver halide color photographic materials. In detail, it relates to a method of obtaining color photographic images by color reversal development after carrying out black-and-white development, by which photographic images having a high maximum density and good color balance are obtained in a high sensitivity. In greater detail, it relates to a method of sensitization treatment by which high sensitivities and high maximum densities are obtained by changing the treatment condition (for example, time, temperature or etc.).

BACKGROUND OF THE INVENTION

Since silver halide color reversal photographic materials have a narrow allowable range of exposure, very restricted suitable exposure is required in order to obtain good images. It is based on the fact that they are designed so as to have hard gradation as compared with color negative photographic materials, in order to finally use them as an observable positive image. Therefore, it is necessary to use photographic materials having an optimum sensitivity corresponding to the purpose and exposure condition. However, the photographic materials are not always suitable for satisfying these requirements. Particularly, few color reversal photographic materials sufficiently satisfy these requirement wherein a very high sensitivity is required. Further, exposure to light is not always carried out under optimum conditions, and excess and deficient exposure are not rare. Under such conditions, it has been greatly desired to provide color reversal photographic materials having a high sensitivity and control of sensitivity by treatment for compensating for excess and deficient exposure.

In order to meet these demands, a number of methods of development acceleration or methods of sensitization (desensitization) development have been proposed hitherto. The most general method used hitherto is that wherein the time of black-and-white development is prolonged or wherein the development temperature is raised. Examples of the former are treatment CR-56 for "Fujichrome Professional RD", "ditto RT" and "ditto RH" by Fuji Photo Film Co., and treatment E-6 for "Ektachrome Professional EPR" and "ditto EPD" by Eastman Kodak Co. Examples of the latter are treatment MCR-42/45 for "Fuji Color Reversal RT-125" and "ditto RT-500" by Fuji Photo Film Co. and treatment VNF-1 and RVNP for "Ektachrome VNF" and "ditto VNF high speed" by Eastman Kodak Co.

These methods are simple, because the sensitivity can be increased by changing only the treatment condition, and they are effective particularly when using an automatic developing apparatus. However, these methods have many faults. Firstly, reduction of the maximum density takes place to a great extent with the increase of sensitivity. It is well known that the quality of the images of a color reversal photographic material is greatly influenced by the maximum density. Secondly, color balance varies with increases in the sensitivity. The color balance is also an important matter for determining the quality of images. Thirdly, the time or the temperature necessary to obtain high sensitivity is greatly prolonged or raised, and, consequently, labor and time for the treatment become great.

For the purpose of merely obtaining a high sensitivity, development accelerators have been proposed, for example, in L.F.A. Mason, Photographic Processing Chemistry (Second Edition), pages 41–44, 112 and 113, The Focal Press (1975). Examples of well known accelerators include polyalkylene oxide compounds, sodium thiosulfate, ammonium, phosphonium or sulfonium type onium compounds and polyonium compounds. However, many of such development accelerators have a tendency to increase fog after the treatment of the photographic materials and a tendency to remarkably reduce gamma, whereby good photographic images cannot be obtained.

Further, according to these methods, a high sensitivity can be obtained, but it is difficult to obtain good quality images simultaneously with satisfactory gamma, fog-prevention, granularity in addition to sensitivity even if the condition (for example, time, temperature or etc.) is varied, when using an identical treating solution.

The present inventors studied a method of treatment for eliminating the above-mentioned faults. Namely, it is a method which comprises using a black-and-white developing solution containing a compound represented by the following general formula (I), which causes little increase in the amount of fog, ($D_{max}$ of the final positive image is high), the development rate is increased, the sensitivity is effectively increased and suitable gradation is obtained.

However, this method of treatment does not always sufficiently satisfy the requirements of users. As indicated above, various sensitivities are required in identical photographic materials. However, when increase of sensitivity is carried out by prolonging the time of black-and-white development according to this method, sensitivities of the blue-sensitive layer, the green-sensitive layer and the red-sensitive layer do not agree with one another, and color tone (the so-called color balance) is damaged.

SUMMARY OF THE INVENTION

The first object of the present invention is to provide a method of developing treatment of color reversal photographic materials, whereby good photographic images having a high maximum density and good color balance are obtained. The second object is to provide a method of developing treatment of color reversal photographic materials, whereby good photographic images having different sensitivites are obtained with the identical photographic materials when the condition is varied.

The present inventors have now found that the above-mentioned faults can be eliminated by treating with a black-and-white developing solution containing a compound represented by the general formula (I) prior to treatment with a conventionally used black-and-white developing solution which does not contain the compound represented by the general formula (I):

$$R_2—(S—R_1)_d—S—R_2 \quad (I)$$

wherein $R_1$ represents an alkylene group having 2 to 10 carbon atoms, which may have ether bonds, $R_2$ represents an alkyl group having 2 to 10 carbon atoms, which may have substituents or may have ether bonds or ester bonds, and d represents an integer of 0 to 3.

DETAILED DESCRIPTION OF THE INVENTION $R_1$ in the general formula (I) may be a straight chain alkylene group or a branched chain alkylene group. A suitable example of a general formula for alkylene groups having ether bonds is $—C_nH_{2n}—(OC_nH_{2n})_m—$, wherein the total carbon number is 2 to 10 and m is an integer of 1 to 2.

$R_2$ in the general formula (I) may be a straight chain alkyl group or a branched chain alkyl group. Substituents on the alkyl group include a hydroxy group and carboxyl group with a hydroxy group being preferable. Examples of $R_2$ include the following groups: $—C_pH_{2p}OH$, $—(C_pH_{2p}O)_q—C_sH_{2s+1}$, $—(C_pH_{2p}O)_q—C_sH_{2s}OH$, $—(C_pH_{2p}COO)_q—C_sH_{2s+1}$, and $—(C_pH_{2p}COO)_q—C_sH_{2s}OH$, etc., wherein p and s each is a positive integer, the total carbon number is 2 to 10, and q is an integer of 1 and 2.

A preferred example of d is an integer of 1 or 2.

Examples of typical compounds of general formula (I) used in the present invention include the following compounds:

(1) $HOCH_2CH_2SCH_2CH_2OCH_2CH_2OCH_2CH_2SCH_2CH_2OH$
(2) $CH_3CH_2OCH_2CH_2OCH_2CH_2SCH_2CH_2OCH_2CH_2SCH_2CH_2OCH_2CH_2OCH_2CH_3$
(3) $(HO(CH_2)_2S(CH_2)_2S(CH_2)_2S(CH_2)_2OH$
(4) $CH_3OCH_2CH_2SCH_2CH_2OCH_2CH_2OCH_2CH_2SCH_2CH_2OCH_3$
(5) $CH_3CH_2OCH_2CH_2OCH_2CH_2OCH_2CH_2SCH_2CH_2OCH_2CH_2OCH_2CH_2OCH_2CH_3$
(6) $CH_3CH_2OCH_2CH_2SCH_2CH_2OCH_2CH_2OCH_2CH_2SCH_2CH_2OCH_2CH_3$
(7) $CH_3CH_2OCH_2CH_2SCH_2CH_2OCH_2CH_2SCH_2CH_2OCH_2CH_3$
(8) $CH_3CH_2OCH_2CH_2OCH_2CH_2SCH_2CH_2SCH_2CH_2OCH_2CH_2OCH_2CH_3$
(9) $HOCH_2CH_2OOCCH_2SCH_2CH_2OCH_2CH_2SCH_2COOCH_2CH_2OH$
(10) $HO(CH_2)_5S(CH_2)_5S(CH_2)_5OH$
(11) $HO(CH_2)_6S(CH_2)_5S(CH_2)_6OH$
(12) $HO(CH_2)_9S(CH_2)_5S(CH_2)_9OH$
(13) $HO(CH_2)_{10}S(CH_2)_5S(CH_2)_{10}OH$
(14) $HO(CH_2)_2S(CH_2)_6S(CH_2)_2OH$
(15) $HO(CH_2)_2S(CH_2)_2S(CH_2)_2OH$
(16) $HO(CH_2)_3S(CH_2)_2S(CH_2)_3OH$
(17) $HO(CH_2)_4S(CH_2)_2S(CH_2)_4OH$
(18) $HO(CH_2)_5S(CH_2)_2S(CH_2)_5OH$
(19) $HO(CH_2)_6S(CH_2)_2S(CH_2)_6OH$
(20) $HO(CH_2)_9S(CH_2)_2S(CH_2)_9OH$
(21) $HO(CH_2)_{10}S(CH_2)_2S(CH_2)_{10}OH$
(22) $HO(CH_2)_2S(CH_2)_3S(CH_2)_2OH$
(23) $HO(CH_2)_3S(CH_2)_3S(CH_2)_3OH$
(24) $HO(CH_2)_4S(CH_2)_3S(CH_2)_4OH$
(25) $HO(CH_2)_5S(CH_2)_3S(CH_2)_5OH$
(26) $HO(CH_2)_6S(CH_2)_3S(CH_2)_6OH$
(27) $HO(CH_2)_9S(CH_2)_3S(CH_2)_9OH$
(28) $HO(CH_2)_{10}S(CH_2)_3S(CH_2)_{10}OH$
(29) $HO(CH_2)_2S(CH_2)_4S(CH_2)_2OH$
(30) $HO(CH_2)_3S(CH_2)_4S(CH_2)_3OH$
(31) $HO(CH_2)_4S(CH_2)_4S(CH_2)_4OH$
(32) $HO(CH_2)_5S(CH_2)_4S(CH_2)_5OH$
(33) $HO(CH_2)_6S(CH_2)_4S(CH_2)_6OH$
(34) $HO(CH_2)_9S(CH_2)_4S(CH_2)_9OH$
(35) $HO(CH_2)_{10}S(CH_2)_4S(CH_2)_{10}OH$
(36) $HO(CH_2)_2S(CH_2)_5S(CH_2)_2OH$
(37) $HO(CH_2)_3S(CH_2)_5S(CH_2)_3OH$
(38) $HO(CH_2)_3S(CH_2)_6S(CH_2)_3OH$
(39) $HO(CH_2)_4S(CH_2)_6S(CH_2)_4OH$
(40) $HO(CH_2)_5S(CH_2)_6S(CH_2)_5OH$
(41) $HO(CH_2)_6S(CH_2)_6S(CH_2)_6OH$
(42) $HO(CH_2)_9S(CH_2)_6S(CH_2)_9OH$
(43) $HO(CH_2)_2S(CH_2)_2S(CH_2)_2S(CH_2)_2OH$
(44) $HO(CH_2)_3S(CH_2)_3S(CH_2)_3S(CH_2)_2OH$
(45) $HO(CH_2)_2S(CH_2)_2S(CH_2)_2S(CH_2)_2S(CH_2)_2OH$
(46) $HO(CH_2)_3S(CH_2)_3S(CH_2)_3S(CH_2)_3S(CH_2)_3OH$
(47) $HO(CH_2)_6S(CH_2)_9S(CH_2)_6OH$
(48) $HO(CH_2)_9S(CH_2)_9S(CH_2)_9OH$
(49) $HO(CH_2)_{10}S(CH_2)_9S(CH_2)_{10}OH$
(50) $HO(CH_2)_2S(CH_2)_{10}S(CH_2)_2OH$
(51) $HO(CH_2)_3S(CH_2)_{10}S(CH_2)_3OH$
(52) $HO(CH_2)_4S(CH_2)_{10}S(CH_2)_4OH$
(53) $HO(CH_2)_5S(CH_2)_{10}S(CH_2)_5OH$
(54) $HO(CH_2)_9S(CH_2)_{10}S(CH_2)_9OH$
(55) $HO(CH_2)_{10}S(CH_2)_{10}S(CH_2)_{10}OH$

Particularly preferred compounds of the general formula (I) are those wherein $R_1$ and $R_2$ each is an alkylene group having 2 to 5 carbon atoms and a hydroxyalkyl group having 2 to 5 carbon atoms, respectively. In the above exemplified compounds, Compounds (3), (15), (16) and (22) are preferred.

The amount of the compound represented by the general formula (I) in case of adding to the black-and-white developing solution (the first bath) of the present invention is in a range of 0.001 to 100 g, preferably 0.03 to 30 g, particularly preferably 0.05 to 10 g, per liter of the developing solution.

Silver halide color photographic materials used in the present invention include silver halide reversal color photographic materials such as reversal color films or reversal color papers, etc.

The treatment used in the present invention includes a two bath black-and-white development step. It is possible to provide an acid bath for stopping and hardening, an alkali bath for development acceleration and a water wash bath, as intermediate steps. After carrying out the two bath black-and-white development, color reversal images can be obtained by carrying out color reversal treatment including color development and desilvering steps which are generally known hitherto.

For example, it is possible to process by the following treatment steps:

(1) The first black-and-white development→the second black-and-white development→water wash→fogging→color development→adjustment→bleaching→fixing→water wash→stabilization→drying.
(2) The first black-and-white development→water wash →the second black-and-white development→water wash→fogging→color development→adjustment→bleaching→fixing→water wash→stabilization→drying.
(3) The first black-and-white development→stopping→the second black-and-white development→water wash→color development→water wash→bleach fixing→water wash→drying.

The first and the second black-and-white developing solutions used in the present invention may contain known developing agents. Useful developing agents include dihydroxybenzenes (for example, hydroquinone), 3-pyrazolidones (for example, 1-phenyl-3-pyrazolidone), aminophenols (for example, N-methyl-p-aminophenol), 1-phenyl-3-pyrazolines, ascorbic acid and heterocyclic compounds in which a 1,2,3,4-tetrahydroquinoline ring and an indolene ring are condensed as described in U.S. Pat. No. 4,067,872, etc. These agents may be used alone or in combination.

The black-and-white developing solutions used in the present invention can contain, if necessary, preservatives (for example, sulfites or bisulfites, etc.), buffer agents (for example, carbonates, boric acid, borates and alkanolamines), alkali agents (for example, hydroxides and carbonates), dissolution assistants (for example, polyethylene glycols and esters thereof), pH controlling agents (for example, organic acids such as acetic acid), sensitizers (for example, quaternary ammonium salts), development accelerators, surface active agents, toning agents, defoaming agents, hardening agents and thickeners, etc.

The first and second black-and-white developing solutions used in the present invention may further contain antifogging agents (for example, halogenides such as potassium bromide or sodium bromide, benzimidazoles, benzotriazoles, benzothiazoles, tetrazoles and thiazoles, etc.) and chelating agents (for example, ethylenediaminetetraacetic acid and alkali metal salts thereof, polyphosphates and nitriloacetic acid salts).

The pH value of the developing solutions prepared as described above is selected so as to give a desired density and contrast, but it is preferred to be in a range of about 8.5 to about 11.5.

As a special state of the first and the second black-and-white developing solutions used in the present invention, there is an activator treatment in which a photographic material which contains the developing agent (for example, in an emulsion layer) is developed with an aqueous solution of alkalis. According to this treatment, the objects of the present invention are also attained.

The treating temperature of the two bath black-and-white development in the present invention is generally 10° to 60° C., preferably 20° to 50° C., and more preferably 30° to 40° C. The temperatures of the two baths may be identical or different from each other. The treating temperature of the other baths is the same as that of the two bath black-and-white development. The treating time of the two bath black-and-white development depends upon relations with the treating temperature and relations with desired photographic properties such as sensitivity, gradation or color balance, etc., but the time for the first black-and-white development is preferably 1 to 20 minutes, more preferably 2 to 15 minutes, and the time for the second black-and-white development is preferably 10 minutes or less. The time for all treatment steps is generally about 20 to 60 minutes, although it is varied depending upon the treated photographic materials.

An acid bath or an alkali bath can be provided between the first black-and-white development step and the second black-and-white development step. These baths may contain, for the purpose of pH control, inorganic acids such as hydrochloric acid, sulfuric acid, nitric acid, phosphoric acid or boric acid, etc., and alkali metal salts thereof, organic acids such as acetic acid, citric acid, tartaric acid or malic acid, etc., and alkali metal salts thereof, and alkali metal hydroxides or carbonates, etc. Further, they may contain swelling restrainers (for example, inorganic salts such as sodium sulfate, etc.), water hardeners (for example, polyphosphoric acid, aminopolycarboxylic acid, phosphoric acid, aminophosphonic acid and salts of them), antioxidants (for example, sulfates) and development restrainers (for example, bromides, iodides or organic development restrainers), etc.

The fogging bath used in the present invention can contain known fogging agents. Namely, there are stannous ion complex salts such as stannous ion-organophosphoric acid complex salts (U.S. Pat. No. 3,617,282), stannous ion-organic phosphonocarboxylic acid complex salts (Japanese Patent Publication No. 32616/81) or stannous ion-aminopolycarboxylic acid complex salts (British Pat. No. 1,209,050) and boron compounds such as boron hydride compounds (U.S. Pat. No. 2,984,567), heterocyclic amine borane compounds (British Pat. No. 1,011,000), etc. The pH of the fogging bath (reversal bath) ranges widely from acid side to alkali side, and it is in a range of pH 2 to 12, preferably 2.5 to 10 and more preferably 3 to 9.

The color developing solution used in the present invention has a composition of a conventional color developing solution containing an aromatic primary amine developing agent. Preferred examples of the aromatic primary amine developing agents are p-phenylenediamine derivatives as described in the following. Preferable examples include N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl)amino]aniline, N-ethyl-N-(β-methanesulfonamidoethyl)-3-methyl-4-aminoaniline, N-(2-amino-5-diethylaminophenylethyl)methanesulfonamide, N,N-dimethyl-p-phenylenediamine, and 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline and salts thereof (for example, sulfates, hydrochlorides, sulfites and p-toluenesulfonates, etc.) as described in U.S. Pat. Nos. 3,656,959 and 3,698,525, etc.

The color developing solution may contain additionally known components for the developing solution. For example, as alkali agents and buffer agents, sodium hydroxide, potassium hydroxide, sodium carbonate, potassium carbonate, sodium tertiary phosphate, potassium tertiary phosphate, potassium metaphosphate and borax, etc., are used alone or as a combination.

To the color developing solution, it is possible to add sulfites which are generally used as preservatives (for example, sodium sulfite, potassium sulfite, potassium bisulfite or sodium bisulfite) and hydroxylamine.

If necessary, suitable development accelerators may be added to the color developing solution. For example, it is possible to use various pyridinium compounds and other cationic compounds as described in U.S. Pat. No. 2,648,604, Japanese Patent Publication No. 9503/69 and U.S. Pat. No. 3,671,247, cationic dyes such as phenosafranine, neutral salts such as thallium nitrate or potassium nitrate, nonionic compounds such as polyethylene glycol or derivatives thereof or polythioethers, etc., as described in Japanese Patent Publication No. 9504/69, U.S. Pat. Nos. 2,533,990, 2,531,832, 2,950,970 and 2,577,127, organic solvents and organic amines described in Japanese Patent Publication No. 9509/69 and Belgian Pat. No. 682,862, ethanolamine, ethylenediamine, and diethanolamine, etc., and accelerators as described in L. F. A. Mason, Photographic Processing Chemistry, pp. 40 to 43 (Focal Press, London, 1966).

Further, the color developing solution may contain aminopolycarboxylic acids such as ethylenediaminetetraacetic acid, nitrilotriacetic acid, cyclohexanediaminetetraacetic acid, iminodiacetic acid, N-hydroxymethylethylenediaminetriacetic acid or diethylenetriaminepentaacetic acid, etc., as water hardeners.

To the color developing solution, competitive couplers or balancing developing agents may be added.

As the competitive couplers, citrazinic acid J-acid, and H-acid, etc., are useful.

As the balancing developing agents, p-aminophenol, N-benzyl-p-aminophenol and 1-phenyl-3-pyrazolidone, etc., can be used.

The pH of the color developing solution is preferred to be in a range of about 8 to 13. The temperature of the color developing solution is selected from a range of 20° C. to 70° C., preferably 30° C. to 60° C.

Photographic emulsion layers after the color development are generally subjected to bleach treatment. The bleach treatment may be carried out simultaneously with fixing treatment or may be carried out separately. Useful bleaching agents include compounds of polyvalent metal such as iron (III), cobalt (IV), chromium (VI) or copper (II), etc., peracids, quinones and nitroso compounds. For example, it is possible to use ferricyanides, bichromates, organic complex salts of iron (III) or cobalt (III), complex salts of aminopolycarboxylic acids such as ethylenediaminetetraacetic acid, nitrilotriacetic acid or 1,3-diamino-2-propanoltetraacetic acid, etc., or of organic acids such as citric acid, Tartaric acid or malic acid, etc., persulfates, permanganates and nitrosophenol, etc. Among them, potassium ferricyanide, sodium ethylenediaminetetraacetato iron (III) complex and ammonium ethylenediaminetetraacetato iron (III) complex are particularly useful. Aminopolycarboxylic acid iron (III) complex salts are useful for both the bleaching solution and the one-bath bleach-fixing solution.

To the bleaching or bleach-fixing solution, it is possible to add various additives including bleach accelerators described in U.S. Pat. Nos. 3,042,520 and 3,241,966 and Japanese Patent Publications Nos. 8506/70 and 8836/70.

In the fixing bath of the present invention, an ammonium salt, sodium salt or potassium salt of thiosulfuric acid is used as a fixing agent in an amount of 30 g/l to 200 g/l. In addition, the fixing bath may contain stabilizers such as sulfates or metabisulfites, etc., hardening agents such as potassium alum, etc., and pH buffer agents such as acetate, borate, phosphate or carbonate, etc. The pH of the fixing solution is 3 to 10, preferably 5 to 9.

The method of treatment of the present invention can be utilized not only for color photographic processes wherein dye forming couplers are contained in the photographic material, such as processes as described in U.S. Pat. Nos. 2,322,027, 2,376,679 and 2,801,171, but also for color photographic processes wherein dye forming couplers are contained in the developing solution, such as processes as described in U.S. Pat. Nos. 2,252,718, 2,590,970 and 2,592,243.

However, at the present time, the former processes are chiefly used. When the dye forming couplers are contained in the photographic material, multilayer photographic materials are generally used. It is desirable that the couplers stay in a certain layer during the steps for production, during preservation and during the steps of treatment so as not to diffuse into other layers.

In the method of photographic treatment of the present invention, known suitable couplers can be used for forming dye images. The couplers may be any of 4-equivalent ones and 2-equivalent ones. Further, colored couplers for color correction, non-coloring couplers or couplers which release a development inhibitor by development (the so-called DIR couplers) may be used.

As yellow couplers, known open-chain ketomethylene couplers can be used. Among them, benzoyl acetanilide compounds and pivaloyl acetanilide compounds are advantageously used.

As magenta couplers, 5-pyrazolone compounds are chiefly used, but imidazolone compounds and cyanoacetyl compounds can be used, too.

As cyan couplers, phenol or naphthol derivatives are chiefly used.

In addition, couplers which release a development inhibitor in a color reaction (the so-called DIR coupler) or compounds which release a development inhibiting compound may be added.

In order to satisfy properties required for the photographic materials, two or more kinds of the above-described couplers may be added to the same layer. Of course, the same coupler may be added to two or more layers.

These couplers are generally dispersed in the silver halide photographic emulsion layers together with suitable solvents having polarity. Examples of useful solvents include tri-o-cresyl phosphate, trihexyl phosphate, dioctylbutyl phosphate, dibutyl phthalate, diethyl laurylamide, 2,4-diallylphenol and octyl benzoate, etc.

The color photographic materials to be subjected to photographic treatment by the method of the present invention are those which have at least one silver halide emulsion layer on a base, which generally have a red-sensitive silver halide emulsion layer, a green-sensitive silver halide emulsion layer and a blue-sensitive silver halide emulsion layer on a base. Generally, at least a red-sensitive silver halide emulsion layer containing a cyan image forming coupler, at least a green-sensitive silver halide emulsion layer containing a magenta image forming coupler and at least a blue-sensitive silver halide emulsion layer containing a yellow image forming coupler are provided on a base. Such photographic elements may have insensitive photographic layers (for example, an antihalation layer, an intermediate layer for preventing color mixing, a yellow filter layer and a protective layer, etc.). The order of arrangement of the red-sensitive layer, the green-sensitive layer and the blue-sensitive layer is not restricted.

In the color photohraphic materials to be subjected to photographic treatment by the method of the present invention, any of silver bromide, silver chloride, silver chlorobromide, silver iodobromide and silver iodochlorobromide may be used as silver halide in the photographic emulsion layers. In case of having two or more photographic emulsion layer, a combination of two or more of them may be used. The photographic emulsions can be prepared by known processes, for example, the process described in P. Glafkides, Chimie Photographique (issued by Paul Montel Co., 1967), and they may be produced by any of an ammonia process, a neutral process, an acid process, a single jet process, a reversal mixing process, a double jet process and a controlled double jet process, etc.

The silver halide particles may have any crystal form, for example, cube, octahedron or a mixed crystal form of them, etc.

In the following, the present invention is illustrated in detail with reference to an example. However, the scope of the invention is not limtied thereto.

EXAMPLE

In carrying out the present invention, the following silver halide color photographic material and reversal color photographic treatment were used for examining photographic properties.

1-Hydroxy-4-chloro-2-n-dodecylnaphthamide was added as a cyan coupler and emulsified in a red-sensitive silver iodobromide emulsion (silver iodide: 7% by mol), 1-(2',4'6'-trichlorophenyl)-3-[3''-(2''',4'''-di-t-amylphenoxyacetamido)benzamido]-5-pyrazolone was added as a magenta coupler and emulsified in a green-sensitive silver iodobromide emulsion (silver iodide: 6% by mol), and αpivaloyl-α-[4-(4-benzyloxysulfonyl)-phenoxy]-2-chloro-5-[γ-(2,4-di-s-amylphenoxy)-butyramido]acetanilide was added as a yellow coupler and emulsified in a blue-sensitive silver iodobromide emulsion (silver iodide: 6% by mol). The resulting emulsions were applied in turn to a cellulose triacetate film to prepare a color photographic material.

In order to emulsify each coupler, dibutyl phthalate and tricresyl phosphate were used as coupler solvents and sorbitan monolaurate and sodium dodecylbenzenesulfonate were used as emulsifiers. In addition, sodium 1-(p-nonylphenoxytrioxyethylene)butane-4-sulfonate and lauric acid ester of sucrose were added as coating assistants.

In the sample, a filter layer containing yellow colloidal silver was provided between the green-sensitive emulsion layer and the blue-sensitive emulsion layer, an intermediate layer composed of gelatin containing dispersed di-t-amylhydroquinone was provided between the green-sensitive emulsion layer and the red-sensitive emulsion layer, and a protective layer composed of gelatin as a main component was provided on the blue-sensitive emulsion layer.

After the film was exposed to light through a light wedge, it was subjected to the following treatment.

(Treatment A)-Comparative Treatment

| | | |
|---|---|---|
| Black-and-white development | Make alternations as shown in Table 1 | 38° C. |
| Water wash | 2' | " |
| Reversal | 2' | " |
| Color development | 6' | " |
| Adjustment | 2' | " |
| Bleaching | 6' | " |
| Fixing | 4' | " |
| Water wash | 4' | " |
| Stabilization | 1' | Room temperature |
| Drying | | |

Black-And-White Developing Solution:

| | |
|---|---|
| Water | 700 ml |
| Sodium tetrapolyphosphate | 2 g |
| Sodium sulfite | 20 g |
| Hydroquinone.monosulfonate | 30 g |
| Sodium carbonate (1 hydrate) | 30 g |
| 1-Phenyl-4-methyl-4-methoxy-3-pyrazolidone | 2 g |
| Potassium bromide | 2.5 g |
| Potassium thiocyanate | 1.2 g |
| Potassium iodide (0.1% solution) | 10 ml |
| Water to make | 1,000 ml |
| pH was adjusted to 9.7 | |

Reversal

| | |
|---|---|
| Water | 700 ml |
| 6Na salt of nitrilo-N,N,N—trimethylene-phosphonic acid | 3 g |
| Stannous chloride (2 hydrate) | 1 g |
| Sodium hydroxide | 8 g |
| Glacial acetic acid | 15 ml |

-continued

| | |
|---|---|
| Water to make | 1,000 ml |

Color Development

| | |
|---|---|
| Water | 700 ml |
| Sodium tetrapolyphosphate | 2 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| 4-Amino-3-methyl-N—ethyl-β-hydroxyethyl-aniline sesquisulfate monohydrate | 11 g |
| Ethylenediamine | 3 g |
| Water to make | 1,000 ml |

Adjustment

| | |
|---|---|
| Water | 700 ml |
| Sodium sulfite | 12 g |
| Sodium ethylenediaminetetraacetate (2 hydrate) | 8 g |
| Thioglycerine | 0.4 ml |
| Glacial acetic acid | 3 ml |
| Water to make | 1,000 ml |

Bleaching

| | |
|---|---|
| Water | 800 ml |
| Sodium ethylenediaminetetraacetate (2 hydrate) | 2.0 g |
| Ammonium ethylenediaminetetraacetato iron (III) complex (2 hydrate) | 120.0 g |
| Potassium bromide | 100.0 g |
| Water to make | 1.0 l |

Fixing

| | |
|---|---|
| Water | 800 ml |
| Ammonium thiosulfate | 80.0 g |
| Sodium sulfite | 5.0 g |
| Sodium bisulfite | 5.0 g |
| Water to make | 1.0 l |

Stabilization

| | |
|---|---|
| Water | 800 ml |
| Formalin (37% by weight) | 5.0 ml |
| Fuji Driwel | 5.0 ml |
| Water to make | 1.0 l |

(Treatment B)-Comparative Treatment

Treating steps are the same as in (Treatment A), but the time for black-and-white development was altered as shown in Table 1. Further, as a black-and-white developing solution, a solution prepared by adding 2-mercaptobenzimidazole 1 mg/l and the following compound represented by the general formula (I) to the black-and-white developing solution of (Treatment A) from which sodium thiocyanate was removed was used.

(Treatment B-1) Compound (3)0.3 g/l (Treatment B-2) Compound (15)0.3 g/l.

The other treating solutions were the same as in (Treatment A).

(Treatment C)

Prior to the step of (Treatment A), the film was treated with the black-and-white developing solution used in (Treatment B). In order to obtain preferred photographic properties, the time for two bath black-and-white development was adjusted as shown in Table 1.Further, the other treating solutions were the same as in (Treatment A).

(Treatment D)

Prior to the step of (Treatment A), the film was treated with a black-and-white solution prepared by adding 2-mercaptobenzimidazole 1 mg/l and the following compound represented by the general formula (I) to the black-and-white developing solution used in (Treatment A). The time for two bath black-and-white development was adjusted likewise as shown in Table 1.

(Treatment D-1): Compound (3)0.3 g/l (Treatment D-2): Compound (15)0.3 g/l.

The other treating solutions were the same as in (Treatment A).

Results obtained are shown in Table 1.

TABLE 1

| Sample | Treatment | Time for Black-And-White Development: The First Development (min) | Time for Black-And-White Development: The Second Development (min) | Relative Sensitivity: Blue | Relative Sensitivity: Green | Relative Sensitivity: Red | Difference of Sensitivities (%): Blue-Green | Difference of Sensitivities (%): Red-Green |
|---|---|---|---|---|---|---|---|---|
| 1* | A | — | 6 | 100 | 100 | 100 | ±0 | ±0 |
| 2* | A | — | 11 | 225 | 200 | 185 | +12 | +7 |
| 3* | A | — | 14 | 330 | 290 | 265 | +14 | −9 |
| 4* | B-1 | — | 4 | 240 | 200 | 170 | +20 | −15 |
| 5* | B-1 | — | 8 | 590 | 500 | 430 | +18 | −14 |
| 6* | B-2 | — | 4.5 | 230 | 200 | 170 | +15 | −15 |
| 7* | B-2 | — | 8.5 | 575 | 500 | 430 | +15 | −14 |
| 8 | C-1 | 3.5 | 4 | 210 | 200 | 190 | +5 | −5 |
| 9 | C-1 | 8.0 | 1 | 525 | 500 | 475 | +5 | −5 |
| 10 | C-2 | 3.5 | 4 | 210 | 200 | 190 | +5 | −5 |
| 11 | C-2 | 8.0 | 1 | 530 | 500 | 475 | +6 | −5 |
| 12 | D-1 | 3 | 4.5 | 200 | 200 | 190 | ±0 | −5 |
| 13 | D-1 | 7.5 | 1.5 | 520 | 500 | 500 | +4 | ±0 |
| 14 | D-2 | 3 | 4.5 | 190 | 200 | 200 | −5 | ±0 |
| 15 | D-2 | 7.5 | 1.5 | 480 | 500 | 500 | −4 | ±0 |

*Comparative sample

Relative sensitivity is determined from a ratio of exposure of the density 1.0 on the basis of the sensitivity of Sample 1 being 100.

Difference of sensitivities is shown as a ratio (%) of a difference between green relative sensitivity and blue or red relative sensitivity to the green relative sensitivity.

The following is understood from the results shown in Table 1.

In the comparative example (Treatment A), it takes much time to increase sensitivities, and the difference between green sensitivity and blue sensitivity or red sensitivity becomes great, which deteriorates the color balance. In comparison with this case, in (Treatment B-1) and (Treatment B-2) of comparative examples in which Compound (3) or (15) is respectively used, the sensitivities increase by development for a short time. However, as the above-described differences of sensitivities become greater it causes serious deterioration of color balance.

On the contrary, (Treatment C-1) and (Treatment C-2) according to the method of the present invention show that the difference of sensitivities can be reduced by controlling the time for two bath development so as to obtain the same sensitivity.

Further, the maximum density does not greatly change due to the development time.

Moreover, (Treatment D-1) and (Treatment D-2) according to the method of the present invention show an effect similar to that of (Treatment C1) and (Treatment C-2).

As described above, according to the method of the present invention, it becomes possible to sensitize to desired sensitivities and to remarkably reduce the deterioration of the color balance, by controlling the conditions of two bath black-and-white development. Further, as shown in (Treatment D), the method wherein a black-and-white developng solution used hitherto is used as the second bath and a solution prepared by adding the compound represented by the general formula (I) to the above-described developing solution is used as the first bath has the following advantages, in addition to being easily available.

(1) It is possible to carry out the standard development by treating in steps on and after the second black-and-white development and to carry out sensitization development by treating in step on and after the first black-and white development, and, consequently, it is sufficient to use a single piece of treating equipment.

(2) It is possible to use an over-flow solution obtained by supplying to the second black-and-white developing solution as the first black-and-white developing solution by adding necessary chemicals such as compounds represented by the general formula (I) to the over-flow solution. Consequently, amounts of chemicals to be used can be greatly economized as compared with the case of preparing the solutions, respectively.

Further, a similar effect can be obtained when carrying out water wash or treating with an acid bath or an alkali bath between the first black-and-white development step and the second black-and-white development step.

While the invention has been described in detail and with reference to specific embodiments thereof, it will be apparent to one skilled in the art that various changes and modifications can be made therein without departing from the spirit and scope thereof.

What is claimed is:

1. A method of color reversal treatment of an imagewise exposed silver halide color photographic material, comprising the steps of:

treating the material in a first black-and-white developing solution containing a developer and a compound represented by the following general formula (I):

$$R_2\text{-}(\text{S}-R_1)_d-\text{S}-R_2 \qquad \text{(I)}$$

wherein $R_1$ represents an alkylene group having 2 to 10 carbon atoms, which may have ether bonds, $R_2$ represents an alkyl group having 2 to 10 carbon atoms, which alkyl group may have substituents or may have ether bonds or ester bonds, and d represents an integer of 0 to 3 and treating the material in a second black-and-white developing solution and fogging and color developing the material.

2. A method as claimed in claim 1, wherein $R_1$ is an alkylene group having ether bonds, the alkylene group having the general formula $—C_nH_{2n}—(OC_nH_{2n})_m—$ wherein the total number of carbon atoms is 2 to 10 and m is 1 to 2.

3. A method as claimed in claim 1, wherein $R_2$ is an alkyl group having a hydroxy group or carboxyl group substituent positioned thereon.

4. A method as claimed in claim 3, wherein the $R_2$ alkyl group has a hydroxy group substituent positioned thereon.

5. A method as claimed in claim 1, wherein the $R_1$ and $R_2$ each represents alkylene groups containing 2 to 5 carbon atoms and a hydroxyalkyl group having 2 to 5 carbon atoms.

6. A method as claimed in claim 1, wherein the compound of general formula (I) is the compound:

$$HO(CH_2)_2S(CH_2)_2S(CH_2)_2S(CH_2)_2OH$$

.

7. A method as claimed in claim 1, wherein the compound of general formula (I) is the compound:

$$HO(CH_2)_2S(CH_2)_2S(CH_2)_2OH$$

.

8. A method as claimed in claim 1, wherein the compound of general formula (I) is the compound:

$$HO(CH_2)_3S(CH_2)_2S(CH_2)_3OH$$

.

9. A method as claimed in claim 1, wherein the compound of general formula (I) is the compound:

$$HO(CH_2)_2S(CH_2)_3S(CH_2)_2OH$$

.

10. A method as claimed in claim 1, wherein the compound of general formula (I) is present in the first black-and-white developing solution in an amount in the range of 0.001 to 100 g per liter of the first black-and-white developing solution.

11. A method as claimed in claim 10, wherein the compound of general formula (I) is present in an amount in the range of 0.03 to 30 g per liter of the first black-and-white developing solution.

12. A method as claimed in claim 1, wherein the temperature of the first black-and-white developing solution and the second black-and-white developing solution is in the range of 10° to 60° C.

13. A method as claimed in claim 12, wherein the temperature of the first black-and-white developing solution and the second black-and-white developing solution is in the range of 20° to 50° C.

14. A method as claimed in claim 13, wherein the first black-and-white developing solution and the second black-and-white developing solution have a temperature in the range of 30° to 40° C.

15. A method as claimed in claim 1, wherein the treating in the first black-and-white developing solution is carried out for a period of time in the range of 1 to 20 minutes and the treating in the second black-and-white developing solution is carried out over a period of time of 10 minutes or less.

16. A method as claimed in claim 15, wherein the treating in the first black-and-white developing solution is carried out over a period of time in the range of 2 to 15 minutes.

* * * * *